US011821617B2

(12) United States Patent
Paratwar et al.

(10) Patent No.: US 11,821,617 B2
(45) Date of Patent: Nov. 21, 2023

(54) ARRANGEMENT FOR SEALING PORTION OF WIRES BETWEEN LED ARRAY BOARD AND DRIVER COMPARTMENT IN LED LUMINAIRES

(71) Applicant: Appleton Grp LLC, Rosemont, IL (US)

(72) Inventors: Pratik G. Paratwar, Maharashtra (IN); Harsha N. Devappa, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 8 days.

(21) Appl. No.: 17/695,449

(22) Filed: Mar. 15, 2022

(65) Prior Publication Data

US 2022/0341584 A1 Oct. 27, 2022

(30) Foreign Application Priority Data

Apr. 23, 2021 (IN) ..... 202121018847

(51) Int. Cl.

| | |
|---|---|
| ***F21V 31/00*** | (2006.01) |
| ***F21V 15/01*** | (2006.01) |
| ***F21V 23/00*** | (2015.01) |
| ***F21Y 115/10*** | (2016.01) |

(52) U.S. Cl.

CPC ..... *F21V 31/005* (2013.01); *F21V 15/01* (2013.01); *F21V 23/001* (2013.01); *F21Y 2115/10* (2016.08)

(58) Field of Classification Search

CPC ..... F21V 31/005; F21V 15/01; F21V 23/001; F21Y 2115/10; F21Y 2105/14

See application file for complete search history.

(56) References Cited

U.S. PATENT DOCUMENTS

| | | | | |
|---|---|---|---|---|
| 3,900,393 | A | 8/1975 | Wilson | |
| 8,899,786 | B1 * | 12/2014 | Moghal | F21K 9/60 362/249.02 |
| 9,022,603 | B1 | 5/2015 | Moghal et al. | |
| 9,261,251 | B1 * | 2/2016 | Ladewig | F21V 31/03 |

(Continued)

FOREIGN PATENT DOCUMENTS

| | | |
|---|---|---|
| KR | 20100018508 | 2/2010 |

OTHER PUBLICATIONS

First Examination Report (FER) for India Patent Application No. 202121018847 dated Nov. 25, 2022, pp. 1-5.

*Primary Examiner* — Tsion Tumebo

(74) *Attorney, Agent, or Firm* — McDonnell Boehnen Hulbert & Berghoff LLP

(57) ABSTRACT

The present disclosure relates to and envisages an arrangement for sealing the portion of wires between an LED array board (4) and a driver (6) in an LED luminaire (100). The arrangement for sealing comprises a lens gasket (20) and a gasket channel (16) provided on the operative inner surface and along the periphery of the lens frame (12) for accommodating the lens gasket (20), wherein said lens gasket (20) is also configured to seal portions of the connecting wires (8) which exit the lens assembly (10), said lens gasket (20) provided with a first tab (22) having a pair of first through-holes (24), said first tab (22) extending in a direction transverse to the plane of said lens gasket (20), each of said first through-holes (24) configured to allow leads of the connecting wires (8) to pass therethrough.

12 Claims, 12 Drawing Sheets

(56) References Cited

U.S. PATENT DOCUMENTS

| | | | | |
|---|---|---|---|---|
| 9,494,303 | B2 * | 11/2016 | McGowan | H01R 4/4818 |
| 10,386,058 | B1 * | 8/2019 | Cattoni | F21V 29/763 |
| 2008/0089060 | A1 * | 4/2008 | Kondo | F21V 15/01 362/311.06 |
| 2012/0275162 | A1 * | 11/2012 | Spiro | F21S 8/04 362/294 |
| 2013/0122729 | A1 * | 5/2013 | Daily | F21V 19/003 439/220 |
| 2014/0177226 | A1 * | 6/2014 | Goelz | F21V 29/70 362/294 |
| 2016/0320049 | A1 * | 11/2016 | Bears | F21V 29/76 |
| 2019/0162384 | A1 * | 5/2019 | Lowes | F21V 31/03 |

* cited by examiner

ARRANGEMENT FOR SEALING PORTION OF WIRES BETWEEN LED ARRAY BOARD AND DRIVER COMPARTMENT IN LED LUMINAIRES

FIELD

The present disclosure relates to sealing methods for sealing arrangements for LED luminaires and similar lighting fixtures. Particularly, the present disclosure relates to sealing arrangement for the portion of the wires routed from a driver to an LED array in an LED luminaire and similar lighting fixtures.

BACKGROUND

The background information herein below relates to the present disclosure but is not necessarily prior art.

In existing LED luminaires, the portion of wires routed from a board carrying the LED array to the driver are sealed by applying a RTV (room temperature vulcanizing) sealant and by using complicated techniques for manufacturing for the area where the wires are routed, to provide a sealing that ensures ingress protection. As a result, the precision of the complicated manufacturing processes becomes critical. Besides, the existing arrangement described above degrades overall aesthetic appeal of the luminaire. The existing method of applying an RTV sealant for sealing limits the ease of assembly of LED luminaires.

Thus, there is a need of an arrangement for sealing the portion of wires between an LED array board and a driver in an LED luminaire, which ameliorates the aforementioned issues.

Objects

Some of the objects of the present disclosure, which at least one embodiment herein satisfies, are as follows:

A primary object of the present disclosure is to provide an arrangement for sealing the portion of wires between an LED array board and a driver in an LED luminaire.

Another object of the present disclosure is to provide an arrangement for sealing, which ensures ingress protection.

Yet another object of the present disclosure is to provide an arrangement for sealing, which precludes complicated manufacturing processes and/or assembly techniques.

Still another object of the present disclosure is to provide an arrangement for sealing, which enhances the aesthetic appeal of the LED luminaire.

Other objects and advantages of the present disclosure will be more apparent from the following description, which is not intended to limit the scope of the present disclosure.

SUMMARY

The present disclosure envisages an arrangement for sealing the portion of wires between an LED array board and a driver in an LED luminaire. The LED luminaire is provided with a lens assembly for covering the LED array board. A connecting wire is configured to provide electrical connection between the LED array board and the driver. The arrangement for sealing comprises a lens gasket and a gasket channel. The lens gasket is configured to seal the space enclosed by the lens assembly from the outside, and thus, prevent ingress of fluids from the outside into the enclosed space and thereby prevent damage to the LED array on the LED array board. The gasket channel is provided on the operative inner surface and along the periphery of the lens frame for accommodating the lens gasket. The lens gasket is also configured to seal that portion of the connecting wire which exits the lens assembly. The lens gasket is provided with a first tab having a pair of first through-holes. The first tab extends in a direction transverse to the plane of the lens gasket. Each of the first through-holes is configured to allow a lead of the connecting wire to pass therethrough.

The portion of the lens channel adjacent to the fitted position of the first tab is provided with a wire access slot for allowing the connecting wire to access and pass through the first through-holes on the first tab.

The luminaire frame has a cavity that is positioned between the area where the LED array board is fixed and the location of the driver, so that the connecting wire passes over the cavity in a fully assembled state of the LED luminaire. The arrangement for sealing includes a cavity gasket that is provided with a second tab and a third tab. The second tab and the third tab extends in a direction transverse to the plane of the cavity gasket, and the second tab has a plurality of second through-holes and the third tab has a pair of third through-holes.

Preferably, the second tab and the third tab are configured to be positioned opposite to each other.

In an embodiment, the shape of the cavity and hence the shape of the cavity gasket is rectangular, wherein the second tab and the third tab are positioned on opposite sides of the cavity gasket.

In an embodiment, width of the second tab is larger than the width of the third tab.

In an embodiment, the periphery of the cavity is provided with a corresponding channel for accommodating the cavity gasket.

In an embodiment, the second tab of the lens gasket is positioned adjacent to the first tab of the lens gasket in an assembled configuration.

Preferably, wire access slots, for allowing the connecting wires to access and pass through the second through-holes and the third through-holes, are provided in the channel accommodating the cavity gasket.

In an embodiment, the arrangement for sealing includes a bridge support member that covers the remaining portion of the connecting wire between the cavity gasket and the driver. The bridge support member includes a cavity cover portion at one end for covering the cavity and a bridge portion in the middle.

The present disclosure also envisages a method for providing an arrangement for sealing.

BRIEF DESCRIPTION OF THE ACCOMPANYING DRAWING

An arrangement for sealing the portion of wires between an LED array board and a driver in an LED luminaire, of the present disclosure, will now be described with the help of the accompanying drawing, in which:

FIGS. 5-10 are carried out.

LIST OF REFERENCE NUMERALS

Figure 1A:
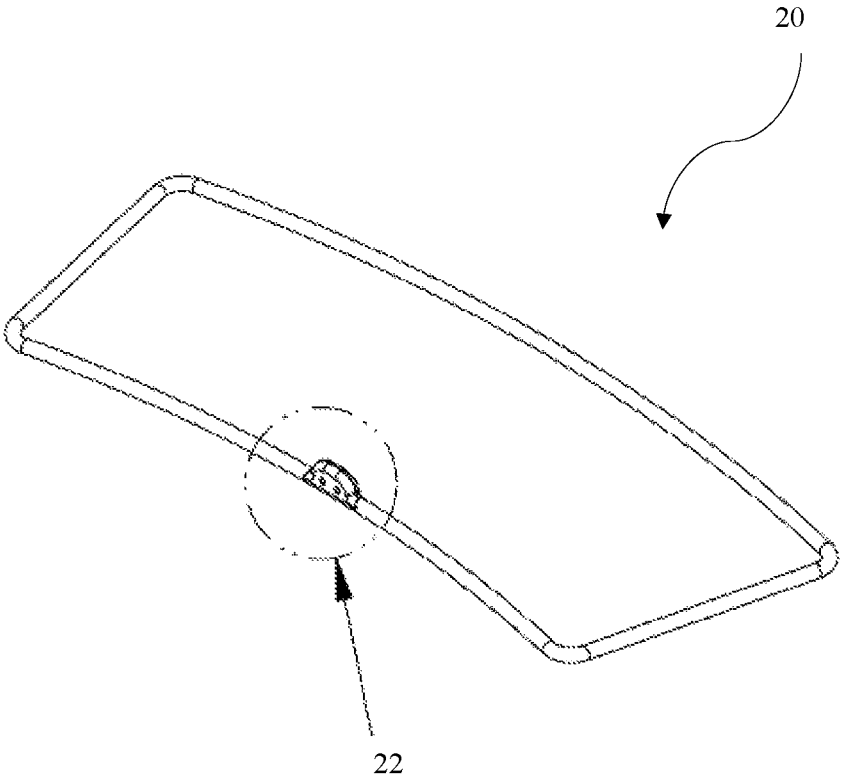
FIG. 1A is an isometric view of a lens gasket according to an embodiment of the present disclosure.

100 LED luminaire
2 Luminaire frame
4 LED array board
5 Connector
6 Driver
8 Connecting wires
10 Lens assembly
12 Lens frame
14 Lens
16 Gasket channel
18 Wire access slot
20 Lens gasket
22 First tab
24 First through-holes
30 Cavity
40 Cavity gasket
42 Second tab
44 Second through-holes
46 Third tab
48 Third through-holes
50 Bridge support member
52 Cavity cover portion
54 Bridge portion

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an" and "the" may be intended to include the plural forms as well, unless the context clearly suggests otherwise. The terms "comprises", "comprising", "including" and "having" are open ended transitional phrases and therefore specify the presence of stated features, elements, modules, units and/or components, but do not forbid the presence or addition of one or more other features, elements, components, and/or groups thereof.

The terms first, second, third, etc., should not be construed to limit the scope of the present disclosure as the aforementioned terms may be only used to distinguish one element, component or section from another component or section. Terms such as first, second, third etc., when used herein do not imply a specific sequence or order unless clearly suggested by the present disclosure.

The arrangement for sealing the portion of wires between an LED array board and a driver in an LED luminaire of the present disclosure shall now be described with the help of FIGS. 1A-11.

The LED luminaire 100 has a luminaire frame 2 that supports an LED array board 4 and a driver compartment 6. Connecting wires 8 connect the LED array board 4 with the driver compartment 6, particularly, with a driver circuit in a driver compartment 6. A connector 5 is configured on the LED array board 4 for plugging free ends of the connecting wires 8. The LED array board 4 is enclosed by a lens assembly 10. The lens assembly 10 comprises a lens frame 12 and a lens 14 fitted in the lens frame 12. The lens 14 is configured to provide a transparent cover for the LED array board 4 enclosed by the lens frame 12. The connecting wires 8 are passed underneath the lens frame 12 to be connected to the LED array board 4. A sealing arrangement is, therefore, required for that portion of the lens assembly 10, and specifically, of the lens frame 12, though which the connecting wires 8 are made to pass.

Further, the luminaire frame 2 has a cavity 30 that is positioned between the area where the LED array board 4 is fixed and the location of thedriver compartment 6. Thus, the connecting wires 8 pass over the cavity 30 in a fully assembled state of the LED luminaire 100. Also, a sealing arrangement is required for that portion of the connecting wires 8 which pass over the cavity 30.

Figure 1B:
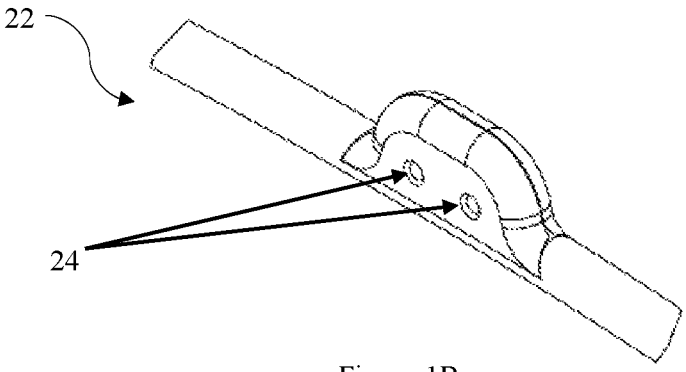
FIG. 1B is a close-up view of first tab of FIG. 1A.
Figure 1C:
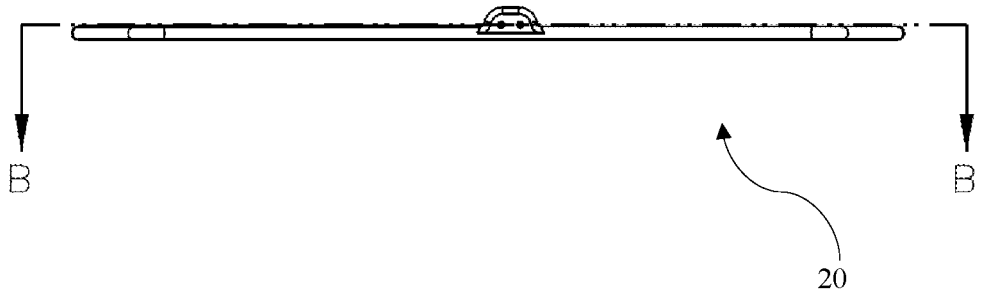
FIG. 1C is a side view of the lens gasket of FIG. 1A.
Figure 1D:
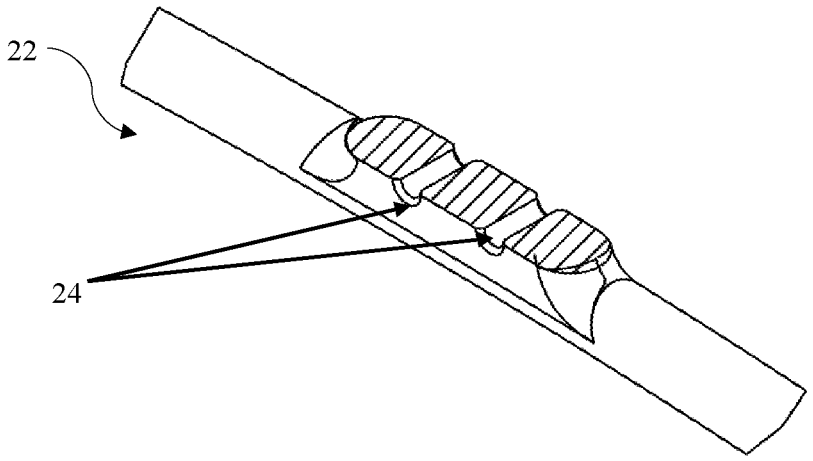
FIG. 1D is an isometric view showing the section B-B taken across the first tab as shown in FIG. 1C.
Figure 2:
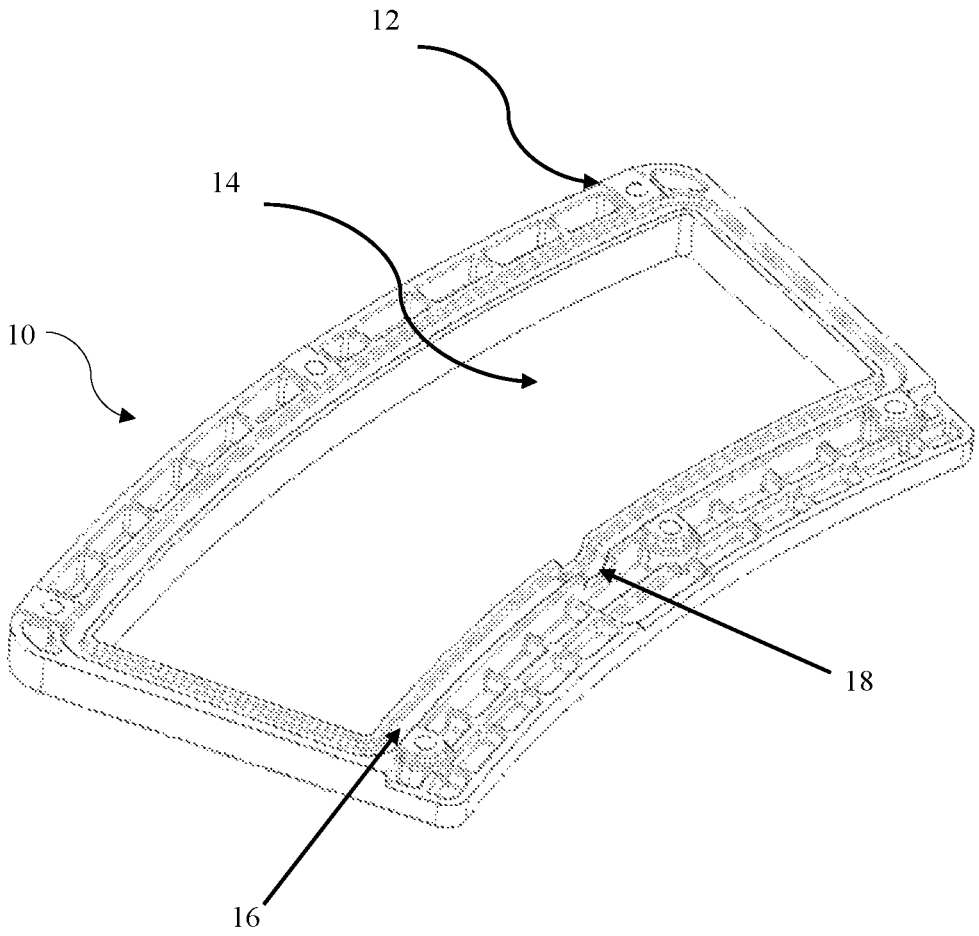
FIG. 2 is an isometric view of a lens with a formation for accommodating the lens gasket of FIG. 1A.

The arrangement for sealing of the present disclosure comprises a lens gasket 20, shown in FIG. 1A. The lens gasket 20 is generally configured to seal the space enclosed by the lens assembly 10 from the outside, and thus, prevent ingress of fluids from the outside into the enclosed space and thereby damage the LED array on the LED array board 4. A gasket channel 16 is provided on the operative inner surface and along the periphery of the lens frame 12 for accommodating the lens gasket 20. According to an aspect of the present disclosure, the lens gasket 20 is also configured to seal that portion of the connecting wires 8 which exit the lens assembly 10. Accordingly, in an embodiment, the lens gasket 20 is provided with a first tab 22 having a pair of first through-holes 24, as illustrated in FIG. 1B. The first tab 22 extends in a direction transverse to the plane of the lens gasket 20. Each of the first through-holes 24 allows leads of the connecting wires 8 to pass therethrough. The portion of the lens channel 16 adjacent to the fitted position of the first tab 22 is provided with a wire access slot 18 for allowing the connecting wires 8 to access and pass through the first through-holes 24 on the first tab 22, as illustrated in FIG. 2.

Figure 3:
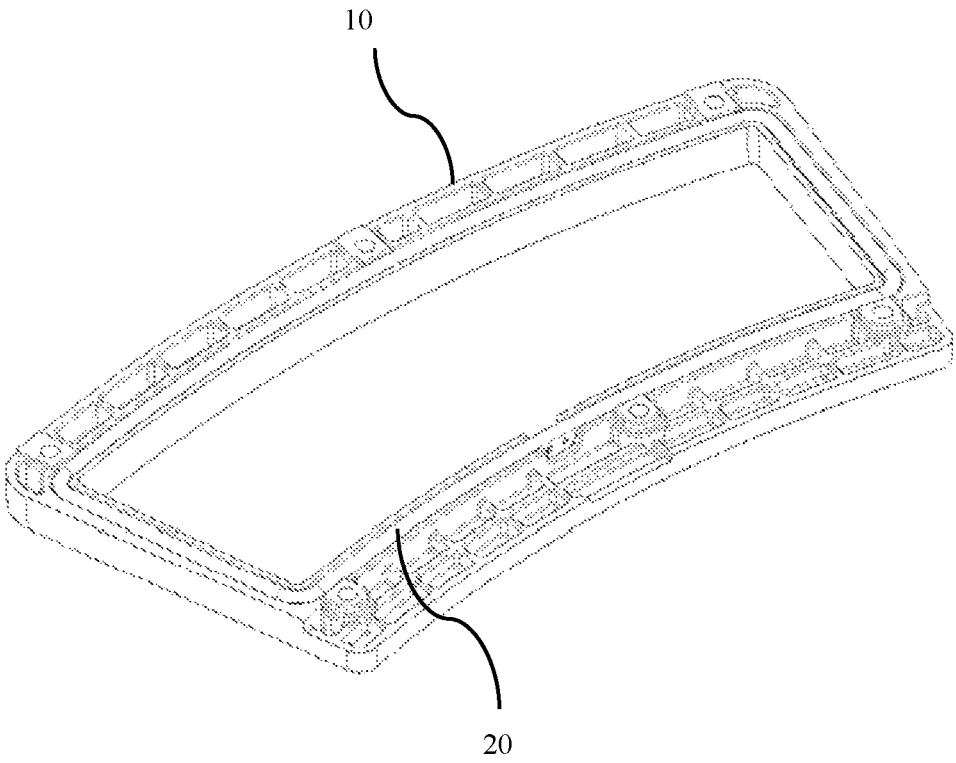
FIG. 3 is an isometric view of an assembly of the lens gasket of FIG. 1A and the lens of FIG. 2.

The fitted configuration of the lens gasket 20 in the lens assembly 10 is illustrated in FIG. 3. The lens gasket 20 is fitted in the gasket channel 16 of the lens frame 12 by inverting the lens frame 12, to have the first tab 22 oriented in a plane perpendicular to the surface of the lens frame 12 and out of the plane of the lens frame 12.

Figure 4:
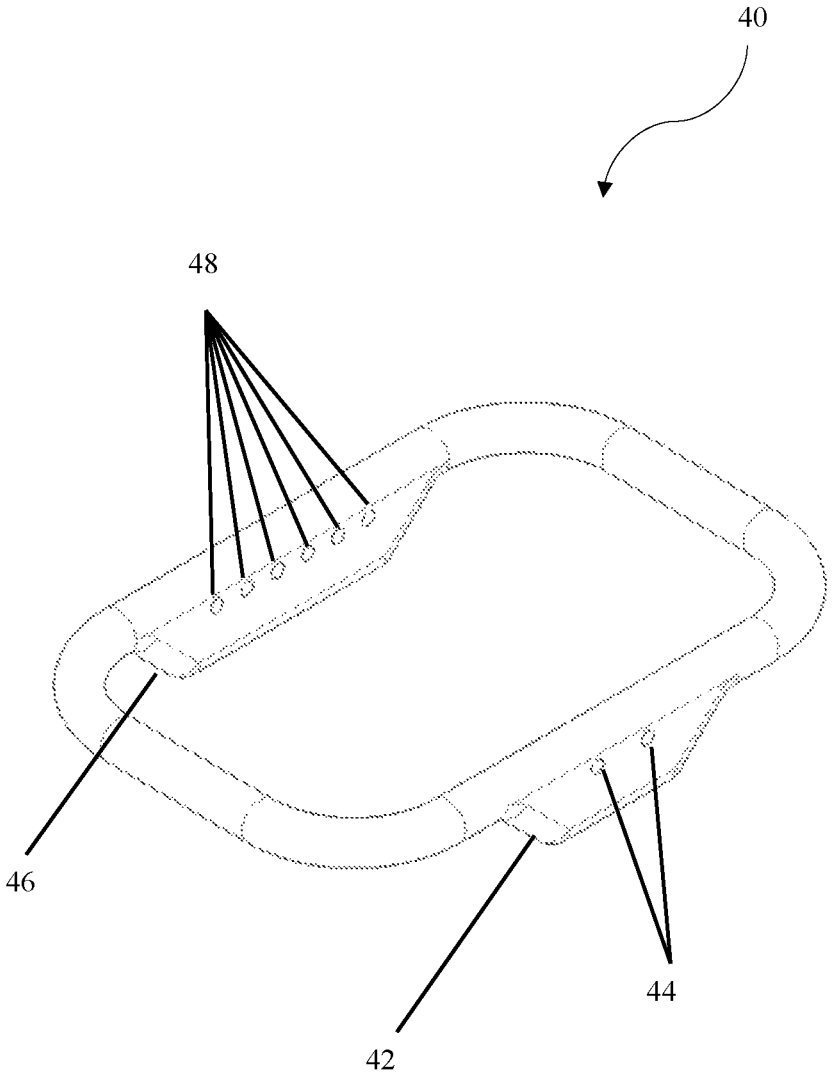
FIG. 4 is an isometric view of a cavity gasket according to an embodiment of the present disclosure.

In an embodiment, the arrangement for sealing of the present disclosure also comprises a cavity gasket 40, an exemplary embodiment of which is illustrated in FIG. 4. The cavity gasket 40 is provided with a second tab 42 and a third tab 46. The second tab 42 and the third tab 46 extends in a direction transverse to the plane of the cavity gasket 40. In an embodiment, the second tab 42 and the third tab 46 are positioned opposite to each other. The shape of the cavity 30 and hence the cavity gasket 40 being rectangular, the second tab 42 and the third tab 46 are positioned on opposite sides of the cavity gasket 40. The second tab 42 has a plurality of second through-holes 44. The third tab 46 has a pair of third through-holes 48. The width of the second tab 42 is therefore larger than the width of the third tab 46. The periphery of the cavity 30 is provided with a corresponding channel (not referred to in Figures) for accommodating the cavity gasket 40. The cavity gasket 40 is fitted in the corresponding channel to have the second tab 42 and the third tab 46 oriented in a plane perpendicular to the periphery of the cavity 30 and out of the plane containing the periphery of the cavity 30. Particularly, the second tab 42 is positioned adjacent to the first tab 22 of the lens gasket 20 in an assembled configuration. Further, wire access slots, for allowing the connecting wires 8 to access and pass through the second through-holes 44 and the third through-holes 48, are provided in the channel accommodating the cavity gasket 40.

Figure 10:
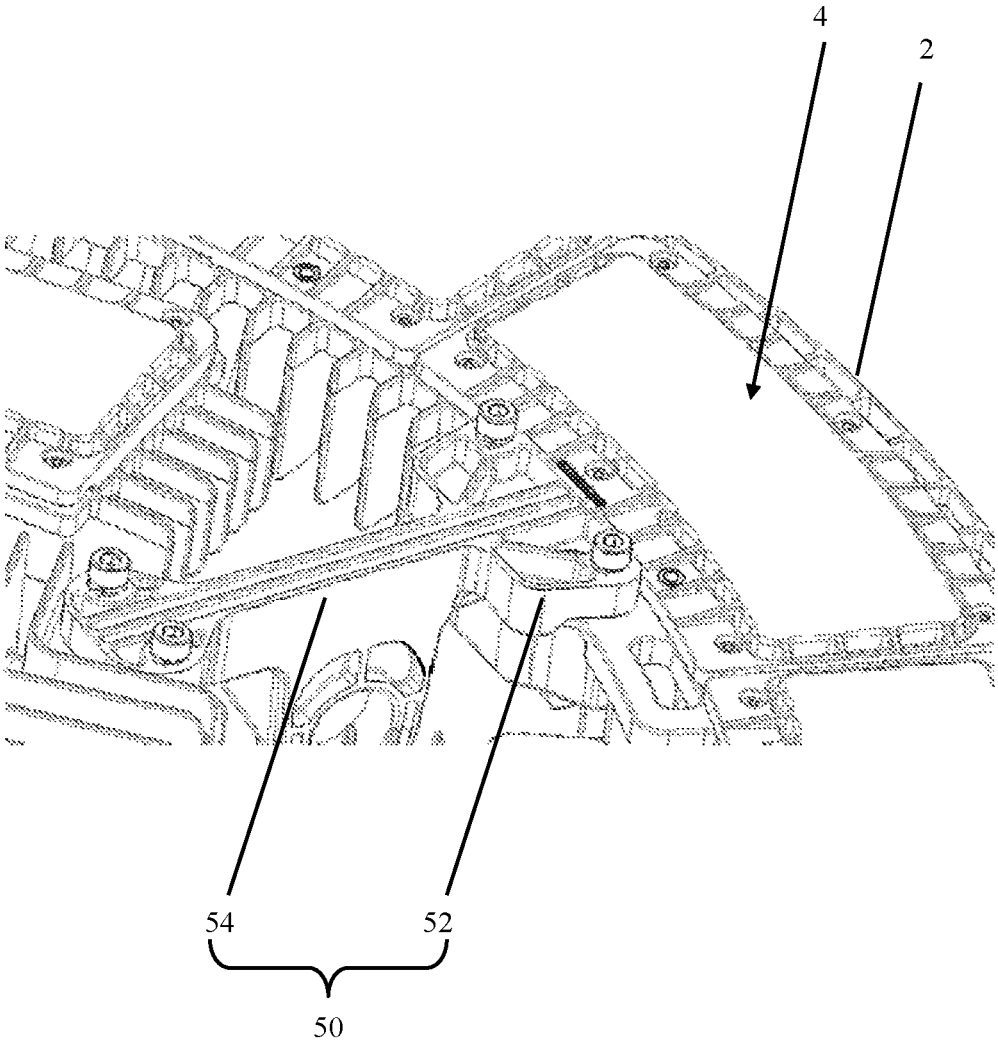
Figure 11:
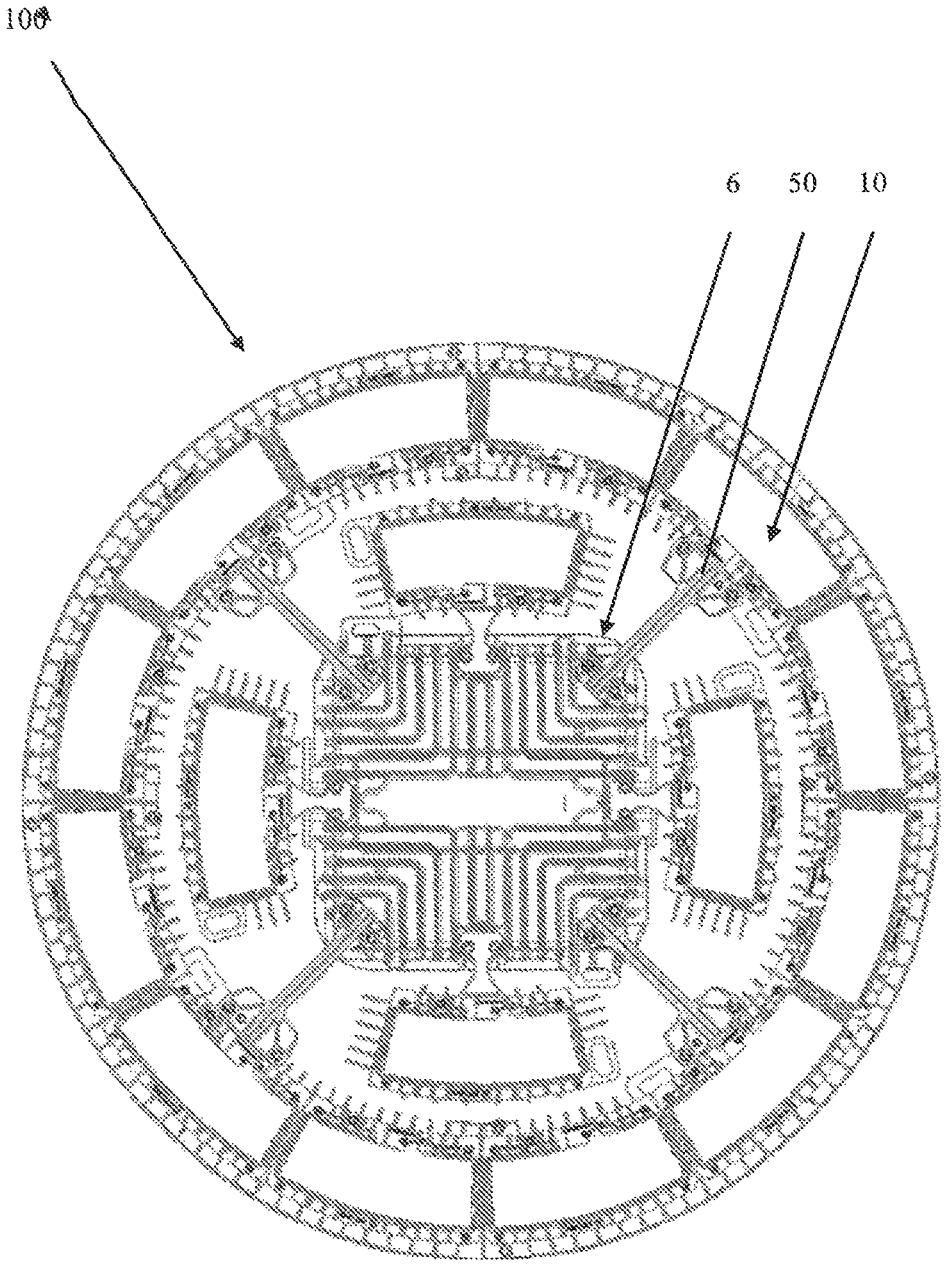
FIG. 11 is a top view of an LED luminaire after steps illustrated

In an embodiment, the arrangement for sealing of the present disclosure includes a bridge support member 50, which is visible in FIG. 10 and FIG. 11, that covers the remaining portion of the connecting wires 8 between the cavity gasket 30 and the driver compartment 6. The bridge support member 50 includes a cavity cover portion 52 at one end for covering the cavity 30 and a bridge portion 54 in the middle. The bridge support member 50 is fitted in fitted on both longitudinal ends using threaded fasteners or a similar reliable means of fitment.

FIGS. 5-10 shall now be referred to illustrate steps of assembly of the arrangement for sealing involving the lens gasket 20 and the cavity gasket 40, according to a preferred embodiment of the present disclosure. FIG. 11 is the top view of an LED luminaire after steps illustrated FIGS. 5-10 are carried out.

Figure 5:
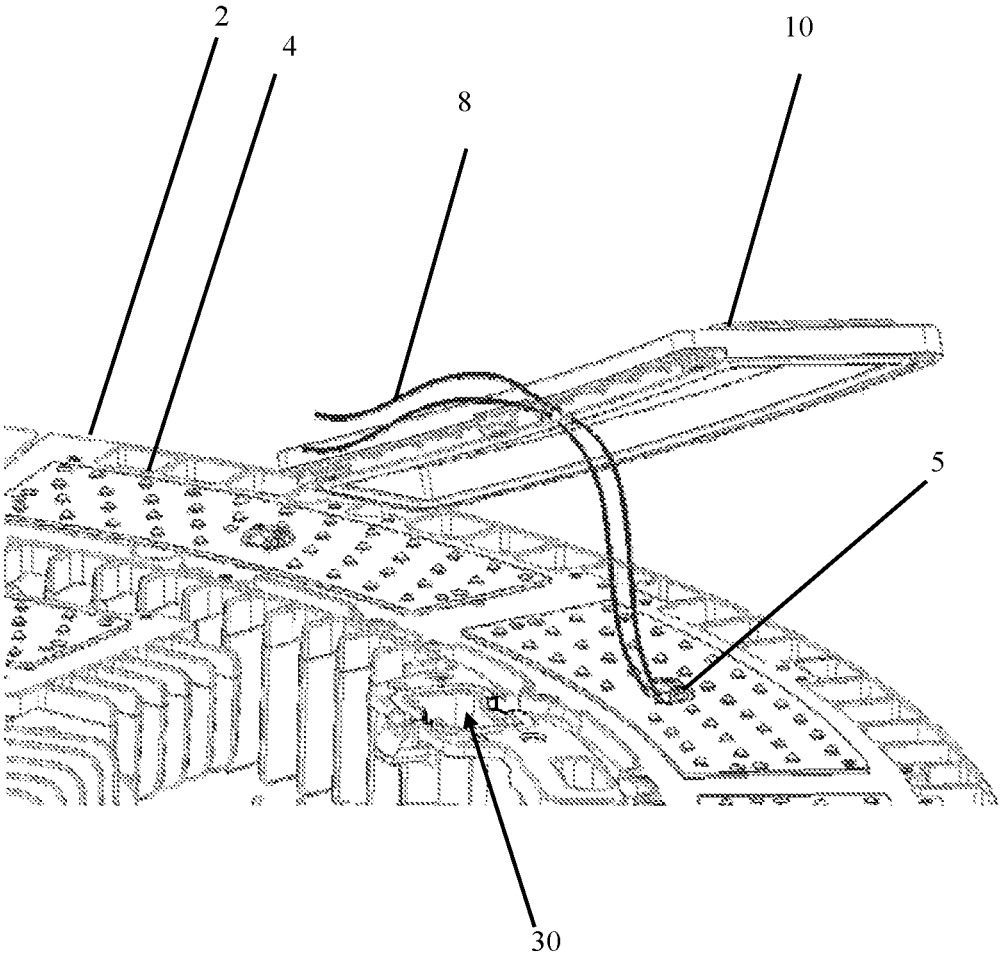
FIGS. 5-10 illustrate steps of assembly of the arrangement for sealing involving the lens gasket of FIG. 1A and the cavity gasket of FIG. 4.
Figure 6:
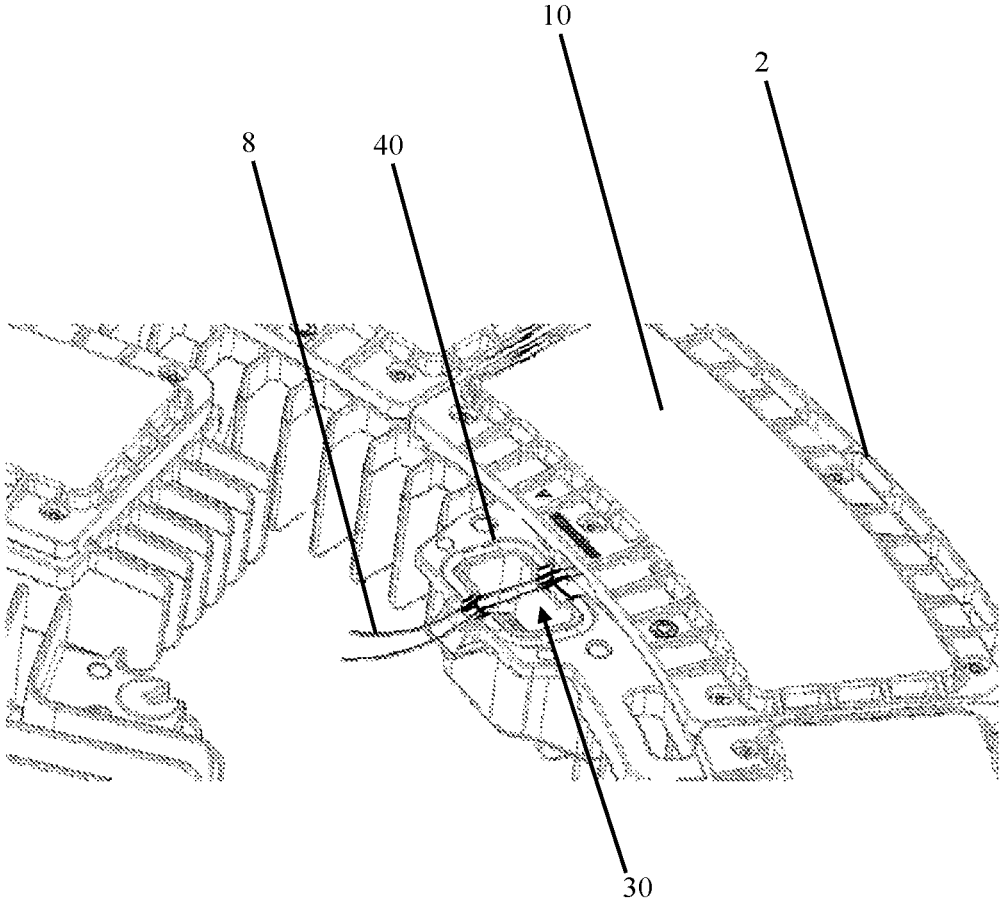
Figure 7:
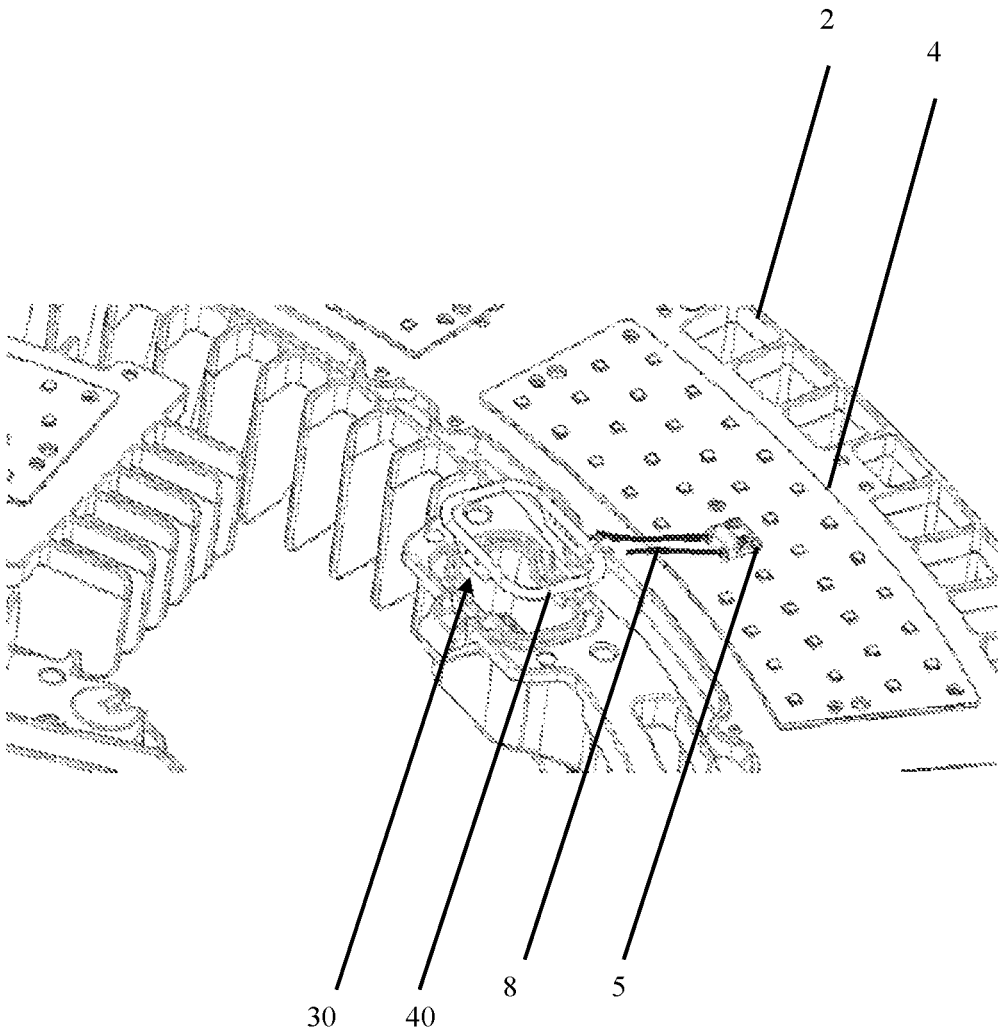
Figure 8:
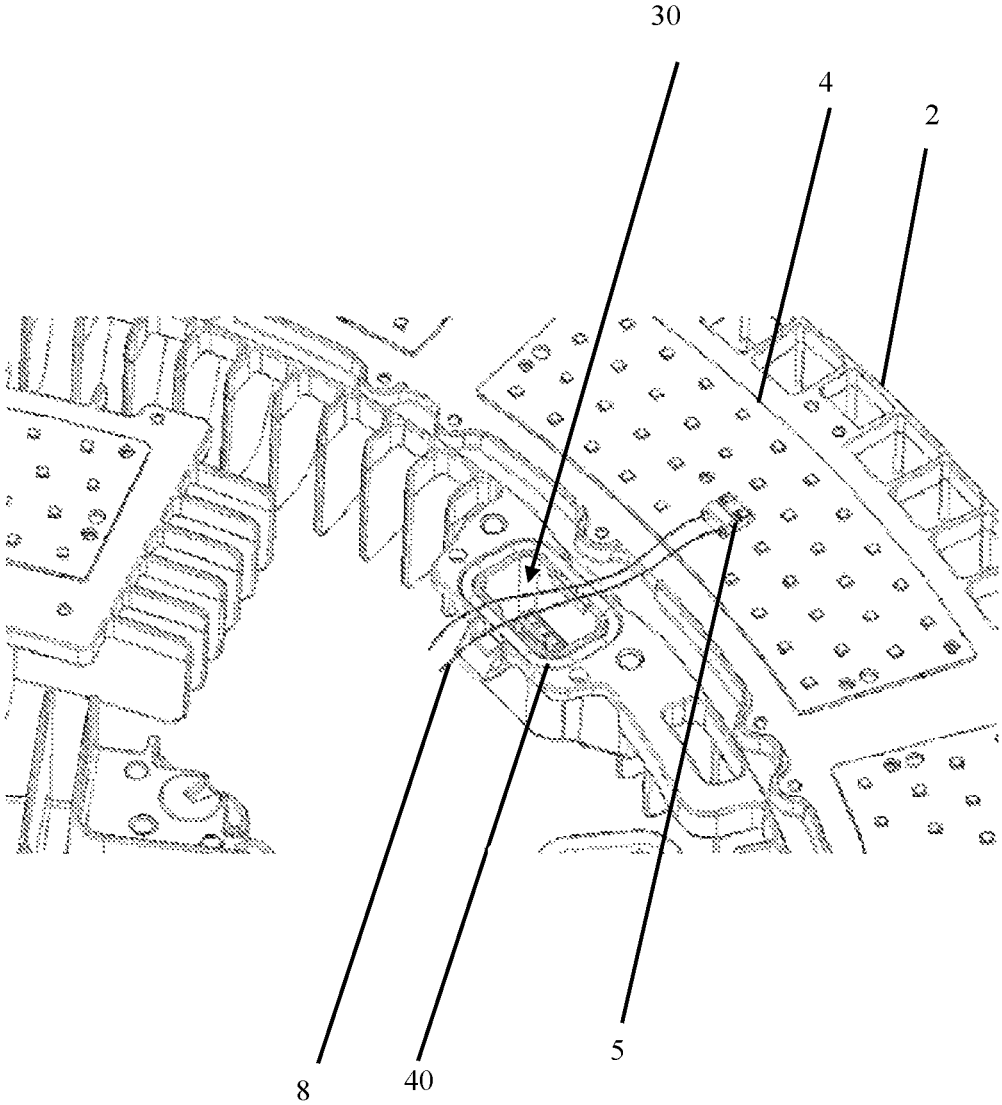
Figure 9:
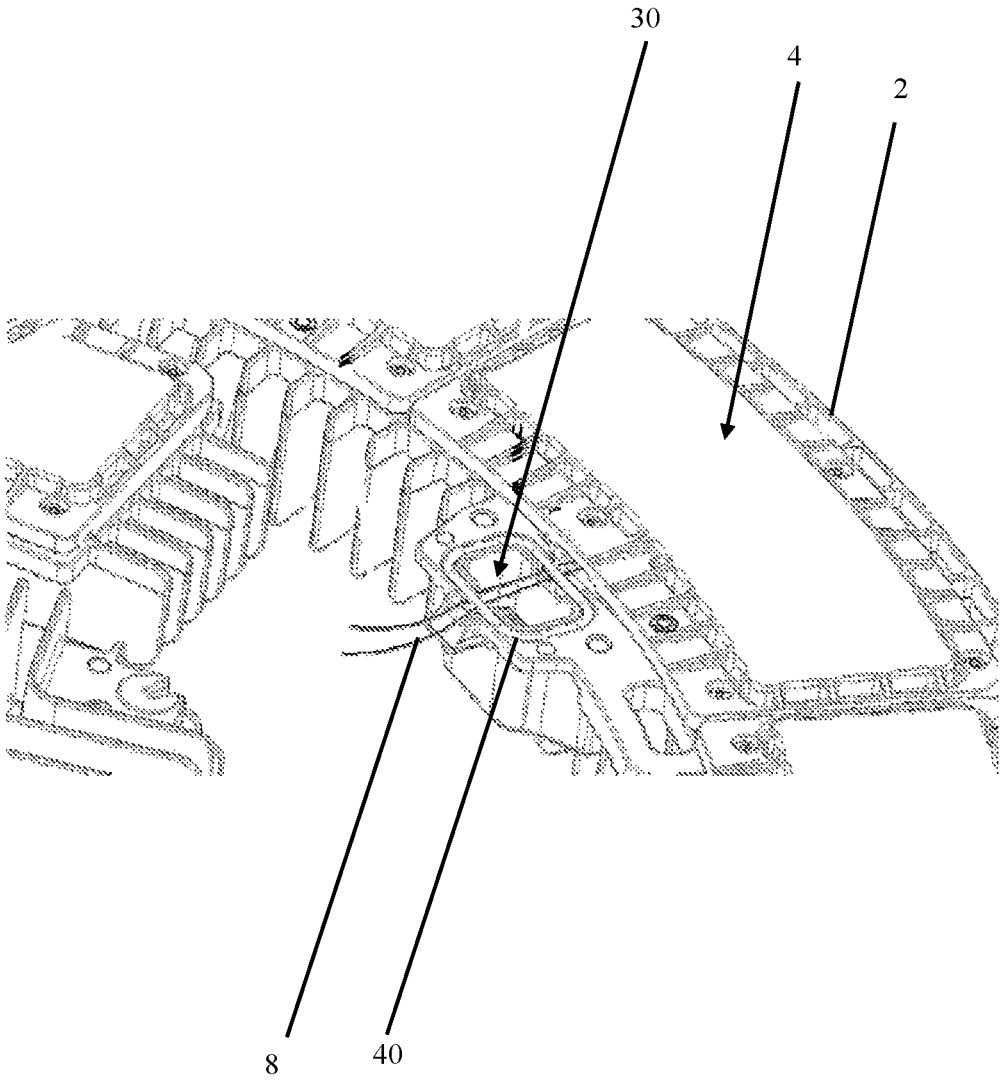

In the first step, the connecting wires 8 are joined to the LED array board 4 through the connector 5. As shown in FIG. 5, the free ends of the connecting wires 8 are passed through the first through-holes 24 of the first tab 22 of the lens gasket 20 fitted in the lens assembly 10. Hence, the lens assembly 10 is fitted in position to cover the LED array board 4, as shown in FIG. 6 (wherein the lens assembly 10 is hidden), by using threaded fasteners or any other reliable means of fitment. The next step involves, shown in FIG. 7 (wherein the lens assembly 10 is hidden), passing of the free ends of the connecting wires 8 through the second through-holes 44 of the second tab 42 and then through the third through-holes 48 of the third tab 46 of the cavity gasket 40. Then, the cavity gasket 40 that is meshed with the connecting wires 8 is press-fitted in the corresponding channel surrounding the cavity 30, as shown in FIG. 8. A true representation of the configuration at the end of this step is shown in FIG. 9. Finally, a bridge support member 50 is fitted in position to cover the remaining overhanging portion of the connecting wires 8, before the free ends of the connecting wires 8 are coupled to the driver compartment 6, as illustrated in FIG. 10. The same steps are repeated for sealing connecting wires of all the LED array boards on the LED frame, to obtain a final assembly of the LED luminaire as illustrated in FIG. 11.

The arrangement for sealing as described hereinabove is not only cheaper than the conventional one that involves use of RTV sealant, but the arrangement also simplifies the assembly process while reducing the number of assembly steps. A reliable, rigid, robust, aesthetically appealing and cost-effective arrangement for sealing the connecting wire between an LED driver and an LED array board is thus provided.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described herein above has several technical advantages including, but not limited to, the realization of an arrangement for sealing the portion of wires between an LED array board and a driver in an LED luminaire, that:

- ensures ingress protection;
- precludes complicated manufacturing processes and/or assembly techniques;
- enhances the aesthetic appeal of the LED luminaire;
- is cheaper than the conventional technique that involves use of RTV sealant;
- simplifies the assembly process while reducing the number of assembly steps; and
- is reliable, rigid and robust.

The embodiments herein and the various features and advantageous details thereof are explained with reference to the non-limiting embodiments in the following description. Descriptions of well-known components and processing techniques are omitted so as to not unnecessarily obscure the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation

We claim:

1. An arrangement for sealing the portion of wires between an LED array board (4) and a driver compartment (6) in an LED luminaire (100), the LED luminaire (100) provided with a lens assembly (10) for covering the LED array board (4), connecting wires (8) configured to provide electrical connection between the LED array board (4) and the driver (6), said arrangement for sealing comprising:

a lens gasket (20) configured to seal the space enclosed by the lens assembly (10) from the outside, and thus, prevent ingress of fluids from the outside into the enclosed space and thereby prevent damage to the LED array on the LED array board (4);

a gasket channel (16) provided on the operative inner surface and along the periphery of a lens frame (12) for accommodating the lens gasket (20);

wherein said lens gasket (20) is also configured to seal that portion of the connecting wires (8) which exit the lens assembly (10), said lens gasket (20) provided with a first tab (22) having a pair of first through-holes (24), said first tab (22) extending in a direction transverse to the plane of said lens gasket (20), each of said first through-holes (24) configured to allow leads of the connecting wires (8) to pass therethrough;

wherein the first tab (22) extends upwardly from lens gasket (20), and first though-holes (24) are positioned above lens gasket (20) such that leads of connecting wires (8) extend above, and not through, lens gasket (20).

2. The arrangement for sealing as claimed in claim 1, wherein portion of said lens channel (16) adjacent to the fitted position of said first tab (22) is provided with a wire access slot 18 for allowing the connecting wires (8) to access and pass through said first through-holes (24) on said first tab (22).

3. An arrangement for sealing the portion of wires between an LED array board (4) and a driver compartment (6) in an LED luminaire (100), the LED luminaire (100) provided with a lens assembly (10) for covering the LED array board (4), connecting wires (8) configured to provide electrical connection between the LED array board (4) and the driver (6), said arrangement for sealing comprising:

a lens gasket (20) configured to seal the space enclosed by the lens assembly (10) from the outside, and thus, prevent ingress of fluids from the outside into the enclosed space and thereby prevent damage to the LED array on the LED array board (4);

a gasket channel (16) provided on the operative inner surface and along the periphery of the lens frame (12) for accommodating the lens gasket (20);

wherein said lens gasket (20) is also configured to seal that portion of the connecting wires (8) which exit the lens assembly (10), said lens gasket (20) provided with a first tab (22) having a pair of first through-holes (24), said first tab (22) extending in a direction transverse to the plane of said lens gasket (20), each of said first through-holes (24) configured to allow leads of the connecting wires (8) to pass therethrough, wherein the LED luminaire (100) has a luminaire frame (2), wherein the luminaire frame (2) has a cavity (30) that is positioned between the area where the LED array board (4) is fixed and the location of the driver (6), so that connecting wires (8) pass over the cavity (30) in a fully assembled state of the LED luminaire (100), wherein said arrangement for sealing includes a cavity gasket (40) that is provided with a second tab (42) and a third tab (46), said second tab (42) and said third tab (46) extending in a direction transverse to the plane of the cavity gasket (40), and said second tab (42) has a plurality of second through-holes (44) and said third tab (46) has a pair of third through-holes (48).

4. The arrangement for sealing as claimed in claim 3, wherein said second tab (42) and said third tab (46) are configured to be positioned opposite to each other.

5. The arrangement for sealing as claimed in claim 3, wherein the shape of the cavity (30) and hence the shape of said cavity gasket (40) is rectangular, wherein said second tab (42) and said third tab (46) are positioned on opposite sides of said cavity gasket (40).

6. The arrangement for sealing as claimed in claim 3, wherein the width of said second tab (42) is larger than the width of the third tab (46).

7. The arrangement for sealing as claimed in claim 3, wherein the periphery of the cavity (30) is provided with a corresponding channel for accommodating the cavity gasket (40).

8. The arrangement for sealing as claimed in claim 3, wherein said second tab (42) is positioned adjacent to said first tab (22) of said lens gasket (20) in an assembled configuration.

9. The arrangement for sealing as claimed in claim 3, wherein wire access slots, for allowing said connecting wires (8) to access and pass through said second through-holes (44) and said third through-holes (48), are provided in the channel accommodating said cavity gasket (40).

10. The arrangement for sealing as claimed in claim 3, which includes a bridge support member (50) that covers the remaining portion of said connecting wires (8) between said cavity gasket (40) and said driver (6).

11. The arrangement for sealing as claimed in claim 3, wherein said bridge support member (50) includes a cavity cover portion (52) at one end for covering the cavity (30) and a bridge portion (54) in the middle.

12. A method for providing an arrangement for sealing as claimed in claim 10, said method comprising the steps of:

i. Joining the connecting wires (8) to the LED array board (4) through a connector (5);

ii. Passing free ends of the connecting wires (8) through said first through-holes (24) of said first tab (22) of said lens gasket (20) fitted in said lens assembly (10);

iii. Fitting said lens assembly (10) in position to cover the LED array board (4);

iv. Passing free ends of the connecting wires (8) through said second through-holes (44) of said second tab (42) and then through said third through-holes (48) of said third tab (44) of said cavity gasket (40);

v. Press-fitting the cavity gasket (40) that is meshed with the connecting wires (8) in the corresponding channel surrounding the cavity (30);

vi. Fitting a bridge support member (50) in position to cover the remaining overhanging portion of the connecting wires (8);

vii. Coupling free ends of the connecting wires (8) to the driver (6);

viii. Repeating steps (i)-(vii) for sealing connecting wires of all the LED array boards on the LED frame, to obtain a final assembly of the LED luminaire.

* * * * *